US006536507B1

(12) United States Patent
Arai et al.

(10) Patent No.: US 6,536,507 B1
(45) Date of Patent: Mar. 25, 2003

(54) COOLING ROLL, METHOD FOR MANUFACTURING MAGNET MATERIAL, RIBBON SHAPED MAGNET MATERIAL, MAGNETIC POWDER AND BONDED MAGNET

(75) Inventors: Akira Arai, Shimosuwa-machi (JP); Hiroshi Kato, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/869,817

(22) PCT Filed: Nov. 6, 2000

(86) PCT No.: PCT/JP00/07797

§ 371 (c)(1),
(2), (4) Date: Jul. 3, 2001

(87) PCT Pub. No.: WO01/32334

PCT Pub. Date: May 10, 2001

(30) Foreign Application Priority Data

Nov. 12, 1999 (JP) ..... 11-323170
Nov. 4, 1999 (JP) ..... 11-313869

(51) Int. Cl.[7] ..... B22D 11/00

(52) U.S. Cl. ..... 164/482; 164/483; 148/101; 148/301; 148/302

(58) Field of Search ..... 164/482, 433, 164/483; 148/101, 301, 302, 303; 252/62.54, 62.55

(56) References Cited

U.S. PATENT DOCUMENTS 4,921,553 A * 5/1990 Tokunga et al. ..... 148/101
4,960,469 A * 10/1990 Tanigawa et al. ..... 148/101
5,549,766 A * 8/1996 Tsutai et al. ..... 148/301

FOREIGN PATENT DOCUMENTS

| | | |
|---|---|---|
| EP | 0 024 506 | 6/1980 |
| JP | 4-28458 | 1/1992 |
| JP | 4-55042 | 2/1992 |
| JP | 5-62813 | 3/1993 |
| JP | 5-135919 | 6/1993 |
| JP | 11-277188 | 10/1999 |
| JP | 2000-77219 | 3/2000 |

OTHER PUBLICATIONS

English language translation of Japanese Patent Document No. 11–277188, Oct. 12, 1999.*

* cited by examiner

*Primary Examiner*—John Sheehan
(74) *Attorney, Agent, or Firm*—Harness, Dickey & Pierce, P.L.C.

(57) ABSTRACT

A cooling roll (5) for producing magnet materials, comprising a roll base material (51) and a surface layer (52) covering the outer periphery of the material, wherein the roll base material (51) is preferably formed of a metal material of a high heat conductivity, and the surface layer (52) is formed of a material lower in heat conductivity than the roll base material (51) and preferably formed of ceramics. The surface layer (52) satisfies the relation, $1.01 \leqq T_{max}/T_{min} \leqq 3$, where $T_{max}$ is the maximum thickness of the surface layer (52), and $T_{min}$ the minimum thickness. The peripheral surface (511) of the roll base material (51) has a surface roughness Ra of 0.03 to 8 $\mu$m.

15 Claims, 2 Drawing Sheets

COOLING ROLL, METHOD FOR MANUFACTURING MAGNET MATERIAL, RIBBON SHAPED MAGNET MATERIAL, MAGNETIC POWDER AND BONDED MAGNET

TECHNICAL FIELD

The present invention relates to cooling roll, a method for manufacturing a magnet material, a ribbon shaped magnet material, a magnetic powder and a bonded magnet.

BACKGROUND ART

A bonded magnet prepared by bonding a magnetic powder with a bonding resin is used for motors and various actuators by taking advantage of its wide degree of freedom of configuration.

Magnet materials constituting the bonded magnet described above are manufactured by, for example, an quenching method using a quenching type ribbon manufacturing apparatus. The manufacturing method is called as a single roll method when the quenching type ribbon manufacturing apparatus comprises a single cooling roll.

In the single roll method, a thin foil (ribbon) shaped magnet material, or a quenched ribbon is continuously manufactured by the steps comprising heating and melting a magnet material with a prescribed alloy composition, ejecting the molten liquid from a nozzle to allow it to collide with the circumference face of a rotating cooling roll, and quenching and solidifying the molten liquid by allowing it to contact the circumference face. The quenched ribbon is pulverized into a magnetic powder, and a bonded magnet is manufactured using this magnetic powder.

A roll (without no surface coating) made of a metal or an alloy, which has high heat conductivity is used for the cooling roll. Alternatively, a surface layer plated with Cr having a lower heat conductivity than the roll base is provided on the surface of the roll for the purpose of improving durability of the roll.

However, when the roll having no surface coating layer as described in the former case above is used, the magnet material is apt to form an amorphous phase due to very rapid cooling rate on the roll contact surface (the surface in contact with the circumference of the cooling roll) of the quenched ribbon obtained. On the free surface (the face opposed to the roll contact surface), on the contrary, the crystal grain size is coarsened due to slow cooling speed as compared with the roll contact surface, resulting in deterioration of magnetic properties.

While heterogeneous distribution of the crystal grain size as described in the latter case is a little relaxed by providing the surface layer comprising a Cr plating layer having a lower heat conductivity as compared with the roll base, the method involved the following problems.

When the Cr plating layer is formed by electroplating on the base, the growth rate of the Cr plating layer usually shows a significant difference depending on the plating site due to surface roughness of the base, and the surface roughness of the base is remarkably reflected on the surface roughness of the plating layer. Accordingly, large voids are formed between the plating layer and the quenched ribbon due to the large surface roughness when the plating layer obtained as described above is directly utilized as the surface layer, causing a large difference in the cooling rate at different sites on the surface layer. As a result, the crystal grain size distribution in the quenched ribbon turns out to be heterogeneous to make it impossible to obtain stable magnetic properties.

Accordingly, a machining such as surface grinding or polishing is usually applied for smoothing the surface after plating. In the machining step applied on the rotating cooling roll, however, uniform processing of the surface along the circumference direction is impossible due to eccentric rotation and mechanical shift and vibration of the cooling roll when the machining as described above is applied to the cooling roll, finally causing heterogeneous distribution of the thickness of the Cr plating layer obtained.

Heat conduction characteristics of the quenched ribbon obtained largely differ among the different sites on the plating layer when the thickness of the plating layer is heterogeneous. Consequently, the alloy of the quenched ribbon has a heterogeneous distribution of the crystal grain size to unable stable and high magnetic properties to be obtained.

The object of the present invention is to provide a cooling roll and a method for manufacturing a magnet material that is able to provide a highly reliable magnet having good magnetic properties, and a ribbon shaped magnet material, magnetic powder and bonded magnet.

DISCLOSURE OF INVENTION

The object of the present invention can be attained by the following aspects and related features described in (1) to (24) below.

(1) The first cooling roll according to the present invention for manufacturing a magnet material has a surface layer on an entire outer circumference of a roll base of the cooling roll, wherein the maximum thickness $T_{max}$ and the minimum thickness $T_{min}$ of the surface layer satisfy the relation of $1.01 \leqq T_{max}/T_{min} \leqq 3$.

(2) The second cooling roll for manufacturing a magnet material has a roll base and a surface layer provided on an entire outer circumference thereof, wherein the surface roughness Ra of a bonding face between the roll base and the surface layer is 0.03 to 8 $\mu$m.

(3)Preferably, the surface layer is manufactured without applying any machining on its surface.

(4) Preferably, the surface layer is formed by a chemical vapor deposition (CVD) method or a physical vapor deposition (PVD) method.

(5) Preferably, the surface layer comprises a ceramic.

(6) Preferably, the mean thickness of the surface layer is 0.5 to 50 $\mu$m.

(7) Preferably, the surface roughness Ra of the surface layer is 0.03 to 8 $\mu$m.

(8) Preferably, the radius of the cooling roll is 50 to 1000 mm.

(9) Preferably, the magnet material is an alloy comprising rare earth elements, transition metals and boron.

(10) The first method for manufacturing the magnet material according to the present invention comprises manufacturing a ribbon shaped magnet material by a quenching method using the cooling roll described in (1) or (2).

(11) The second method for manufacturing the magnet material according to the present invention comprises manufacturing a ribbon of a magnet material by ejecting a molten liquid of the magnet material from a nozzle in an atmospheric gas, and allowing the molten liquid to collide with the circumference face of the cooling roll according to (1) or (2) rotating relative to the nozzle, followed by cooling and solidifying the molten liquid.

(12) Preferably, the atmospheric gas is an inert gas.

(13) Preferably, the circumferencial speed of the cooling roll is 5 to 60 m/sec.

(14) Preferably, the mean thickness of the ribbon shaped magnet material obtained is 10 to 50 $\mu$m.

(15) Preferably, the ribbon shaped magnet material obtained comprises a composite microstructure in which soft magnetic phases and hard magnetic phases are distributed in adjoining relation to one another.

(16) The ribbon shaped magnet material according to the present invention is manufactured by the method according to any one of (10) to (12).

(17) The magnetic powder according to the present invention is obtained by pulverizing the ribbon shaped magnet material manufactured by the method according to any one of (10) to (12).

(18) Preferably, the magnetic powder described above is subjected to at least one time of heat treatment during the manufacturing process or after manufacturing.

(19) Preferably, the magnetic powder comprises a single phase microstructure or a composite phase microstructure with a mean crystal grain size of 500 nm or less.

(20) Preferably, the magnetic powder has a mean grain size of 0.5 to 150 $\mu$m.

(21) The bonded magnet according to the present invention is prepared by bonding the magnetic powder according to (17) or (20) with a bonding material.

(22) Preferably, the bonded magnet contains 75 to 99.5% of the magnetic powder.

(23) Preferably, the bonded magnet has a coercive force $H_{cJ}$ of 320 to 900 kA/m.

(24) Preferably, the bonded magnet has a maximum magnetic energy product $(BH)_{max}$ of 60 kJ/m$^3$ or more.

Figure 1:
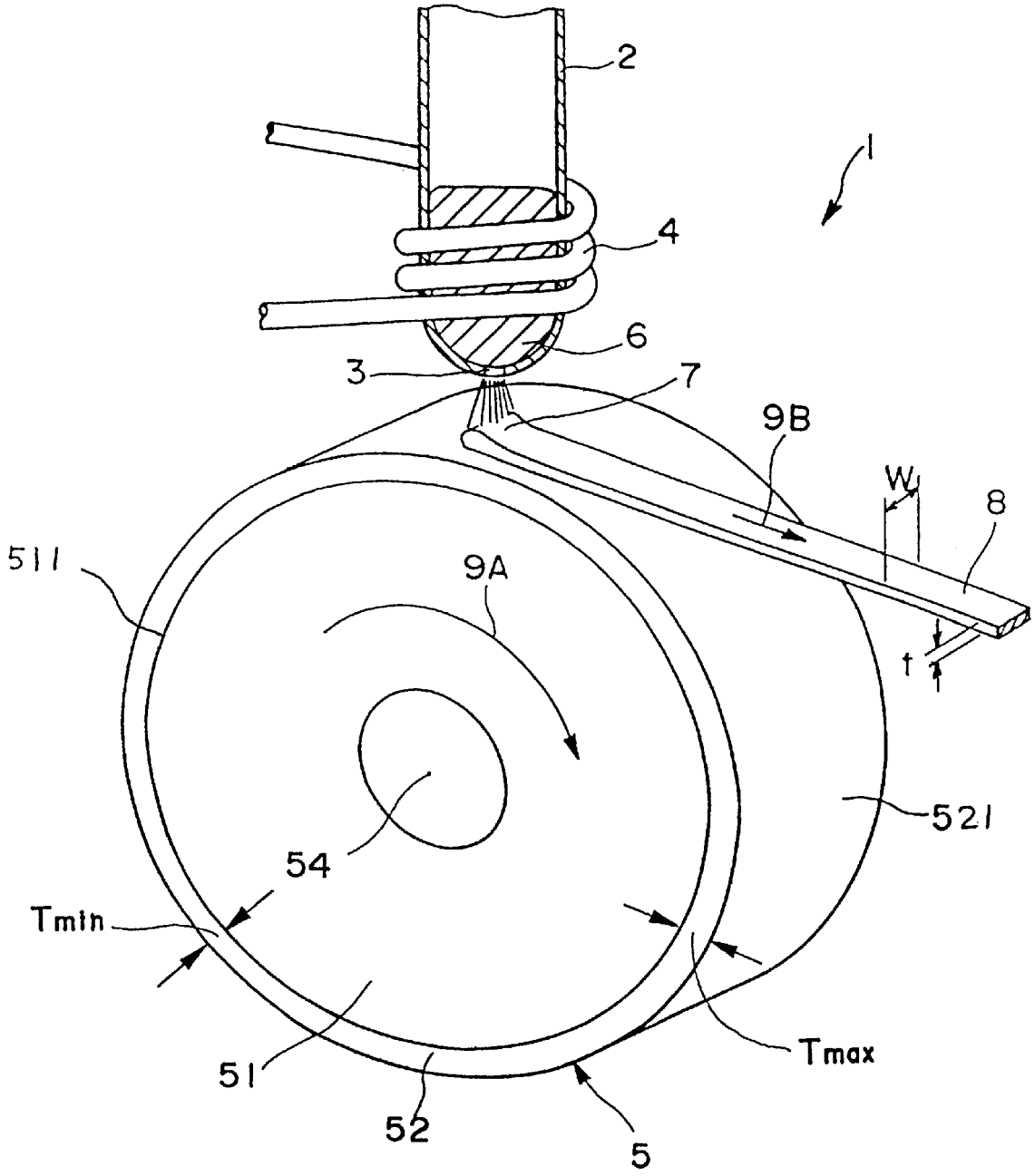
FIG. 1 is a perspective view showing an example of the construction of an apparatus for manufacturing a magnet material (a quenching type ribbon manufacturing apparatus).

A roll (with no surface coating) made of a metal or an alloy, which has high heat conductivity is used for the cooling roll. Alternatively, a surface layer plated with Cr having a lower heat conductivity than the roll base is provided on the surface of the roll for the purpose of improving durability of the roll.

Although the constituting materials of the roll base 51 is not particularly restricted, it preferably comprises a metallic material having a high heat conductivity such as copper or a copper alloy, or iron or an iron alloy so that heat on the surface layer 52 is dissipated as soon as possible.

When the mean thickness t is too small, the amorphous microstructure occupies a larger proportion in the quenched ribbon, and consequently the magnetic properties cannot be sufficiently improved even by a heat treatment thereafter. Mechanical strength of the quenched ribbon 8 also decreases when the mean thickness t is too small to make it difficult to obtain a continuous quenched ribbon 8 resulting in a flake or powder form, consequently arising heterogeneous distribution of the magnetic properties due to uneven cooling. Productivity per unit time is also decreased.

Examples of the thermoplastic resin include polyamide (for example nylon 6, nylon 46, nylon 66, nylon 610, nylon 612, nylon 11, nylon 12, nylon 6–12 and nylon 6–66), thermoplastic polyimide, liquid crystal polymers such as aromatic polyester, polyphenylene oxide, polyphenylene sulfide, polyolefins such as polyethylene, polypropylene and ethylene-vinyl acetate copolymer, modified polyolefin, polycarbonate, polymethyl methacrylate, polyesters such as polyethylene terephthalate and polybutylene_terephthalate, polyether, polyetherketone, polyetherimide and polyacetal, and copolymers, blended resins and polymer alloys mainly comprising thereof. These polymers may be used alone, or as a combination of two or more of them.

Examples of the heat curable reins include various epoxy reins such as bisphenol type, novolac type and napthalene type resins, phenol resins, urea resins, melamine resins, polyester (unsaturated polyester) resins, polyimide resins, silicone resins and polyurethane resins. These resins may be used alone, or in combination of two or more of them.

A flexible (soft) bonded magnet can be prepared in the present invention using flexible binders such as natural rubber (NR), isoprene rubber (IR), butadiene rubbers such as butadiene rubber (BR, 1,2-BR), styrene-butadiene rubber (SBR), special purpose diene rubbers such as chloroprene rubber (CR) and butadiene-acrylonitrile rubber (NBR), olefin rubbers such as butyl rubber (IIR), ethylene-propylene rubber (EPM, ERDM), ethylene vinyl acetate rubber (EVA), acrylic rubber (ACM, ANM) and halogenated butyl rubber (X-IIR), such as urethane rubbers (AU, EU), ether rubbers such as hydrin rubber (CO, ECO, GCO, EGCO), polysulfide rubbers such as polysulfide rubbers (T), various rubbers such as silicone rubbers (Q), fluorinated rubbers (FKM, FZ) and chlorinated polyethylene (CM), and various thermoplastic elastomers such as styrene, polyolefin, polyvinyl chloride, polyurethane, polyester, polyamide, polybutadiene, trans polyisoprene, fluorinated rubber and chlorinated polyethylene elastomers.

The density ρ of the bonded magnet is determined by the specific gravity of the magnetic powder contained therein, and the content and void ratio of the magnetic powder. While the density ρ is not particularly restricted in the bonded magnet according to the present invention, a density of 5.0 g/cm$^3$ or more is preferable, and a density of about 5.5 to 6.6 g/cm$^3$ is more preferable, in the bonded magnet using the binder resins (thermoplastic resins and heat curable resins) as the binder. The density may be less than 5.0 g/cm$^3$ when a flexible (soft) bonded magnet is used.

The bonded magnet according to the present invention preferably has a coercive force $H_{cJ}$ of about 320 to 900 kA/m, more preferably about 400 to 720 kA/m. When the coercive force is smaller than the lower limit described above, demagnetization becomes evident when an inverse magnetic field is applied when the bonded magnet is used for motors besides showing poor heat resistance at a high temperature. Magnetization is decreased, on the other hand, when the coercive force exceeds the upper limit described above. Accordingly, adjusting the coercive force $H_{cJ}$ within the foregoing range allows sufficient magnetization, and a sufficient magnetic flux density, to be achieved even when a sufficient magnetization magnetic field cannot be obtained in endowing the bonded magnet (especially a cylindrical magnet) with multi-polar magnetization, enabling a high performance bonded magnet, in particular a bonded magnet for use in motors, to be provided.

An epoxy resin (binder resin) and a small amount of hydrazine based antioxidant were mixed with each magnetic powder obtained as described above, and the mixture was kneaded to prepare a bonded magnet composition (a compound). The blending ratio (weight ratio) between the magnetic powder and epoxy resin was adjusted to be approximately equal among the samples.

After applying pulse magnetization field with a magnetic field of 3.2 MA/m to magnetize the bonded magnet, the coercive force $H_{cJ}$ and maximum magnetic energy product $(BH)_{max}$ were measured with a direct current recording magnetic flux meter with a maximum applied magnetic field of 2.0 MA/m. The measuring temperature was 23° C. (room temperature). These results are shown in Table 6.

Magnetic powders were obtained by pulverizing two kinds of the quenched ribbons obtained in Example 5.

After applying pulse magnetization with a magnetic field of 3.2 MA/m to magnetizing the bonded magnet, the coercive force $H_{cJ}$ and maximum magnetic energy product $(BH)_{max}$ were measured with a direct current recording magnetic flux meter with a maximum impressed magnetic field of 2.0 MA/m. The measuring temperature was 23° C. (room temperature). These results are shown in Table 8.

The bonded magnet according to the present invention is suitable for use in handy electronic appliances such as a pocket bell (pager) and portable phone, since the bonded magnet is applicable for small size and high performance motors.

BEST MODE FOR CARRYING OUT THE INVENTION

The cooling roll, the method for manufacturing magnet material, and the ribbon shaped magnet material, magnetic powder and bonded magnet according to the present invention according to the present invention will be described in detail with reference to the preferable examples shown in attached drawings.

Figure 2:
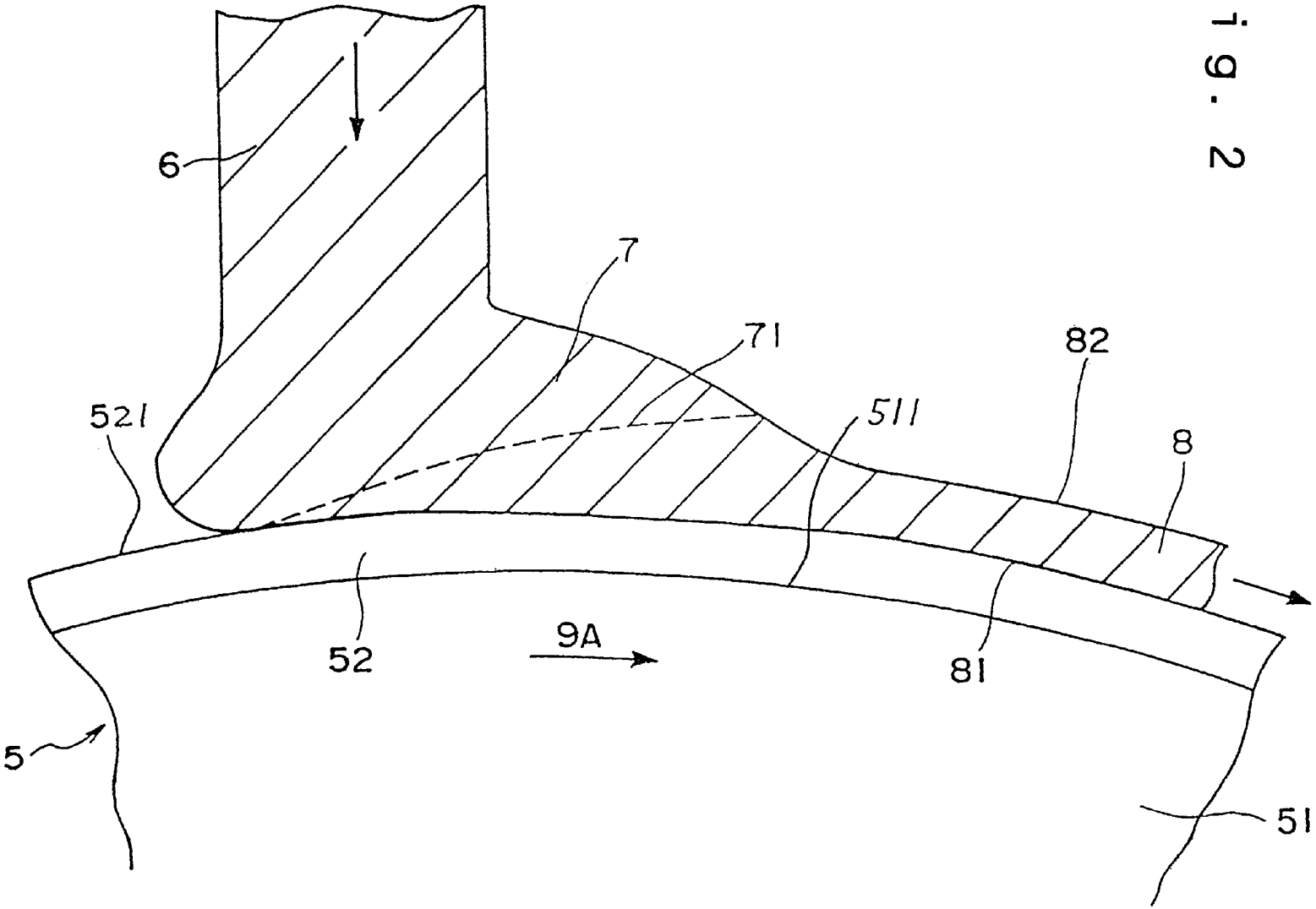
FIG. 2 is a cross sectional side view in the vicinity of the collision part of the molten liquid to the cooling roller in the apparatus shown in FIG. 1.

FIG. 1 is a perspective view showing an example of the construction of an apparatus for manufacturing the magnet material according to the present invention by a single roll method (a quenching type ribbon manufacturing apparatus), and FIG. 2 is a cross sectional side view showing the vicinity of the collision part of the molten liquid to the cooling roll in the apparatus shown in FIG. 1.

As shown in FIG. 1, the quenching type ribbon manufacturing apparatus 1 comprises a cylinder body 2 that can accommodate a magnet material, and a cooling roll 5 rotating toward the direction of an arrow A in the drawing relative to the cylinder body 2. A nozzle (orifice) 3 for ejecting a molten liquid of the magnet material is formed at the lower end of the cylinder body 2.

Quartz or a heat resistant ceramic such as alumina and magnesia is used for the constituting material of the cylinder body 2.

Examples of the shape of the opening of the nozzle 3 include a circle, ellipsoid or slit.

A heating coil 4 is disposed at the outer circumference in the vicinity of the nozzle 3 of the cylinder body 2. The magnet material in the cylinder body 2 is melted by heating (induction heating) the inside of the cylinder body 2 by impressing a microwave on the coil 4.

However, the heating method is not restricted to the coil 4 but, for example, a carbon heated may be used.

The cooling roll is composed of a roll base 51, and a surface layer 52 covering the entire circumference of the outer circumference of the roll base. The circumference face 521 comprises the surface layer 52.

Although the constituting materials of the roll base 51 is not particularly restricted, it is preferably comprises a metallic material having a high heat conductivity such as copper or a copper alloy, or iron or an iron alloy so that heat on the surface layer 52 is dissipated as soon as possible.

The circumference face 511 of the roll base 51 serves as a surface layer bonding face for bonding the surface layer 52. This circumference face 511 has a surface roughness Ra of 0.03 to 8 μm, preferably 0.05 to 5 μm, and more preferably 0.1 to 2 μm.

The surface roughness Ra of the circumference face 521 of the surface layer 52 formed on the circumference face 511 increases when the circumference face 511 on the roll base 51 has a large surface roughness Ra, also increasing the gap distance between the surface layer and the quenched ribbon on the surface layer to cause large differences of the cooling rate among the sites on the surface. As a result, the crystals are made to have heterogeneous crystal grain size distribution to consequently deteriorate magnetic properties. While the circumference face 511 of the roll base 51 favorably has a smaller Ra value, it is considered to be difficult to manufacture a roll base having a Ra value of as small as less than 0.03 μm.

The surface layer 52 is made of a material having a lower heat conductivity than the roll base 51, thereby enabling the difference of the cooling rate between the roll contact surface 81 side and the free surface 82 side of the quenched ribbon 8 to be smaller to make the crystal grain size distribution uniform.

When the surface layer 52 has a large distribution of thickness, the quenched ribbon 8 turns out to have heterogeneous heat conductivity distribution and hence heterogeneous crystal grain size distribution among the sites to unable stable magnetic properties to be obtained. Accordingly, the maximum thickness $T_{max}$ and the minimum thickness $T_{min}$ of the surface layer 52 should satisfy the following equation (I) in order to prevent such homogeneous distribution. The condition as described above allows crystal grain size distribution along the longitudinal direction of the quenched ribbon 8 to be small to enable magnetic properties to be improved.

$$1.01 \leqq T_{max}/T_{min} \leqq 3 \quad \text{(I)}$$

Alternately, it is more preferable that the equation (II) is satisfied, and it is more preferable that the equation (III) is satisfied, in place of the equation (I).

$$1.01 \leqq T_{max}/T_{min} \leqq 2 \quad \text{(II)}$$

$$1.05 \leqq T_{max}/T_{min} \leqq 1.5 \quad \text{(III)}$$

While the smaller value of $T_{max}/T_{min}$ is desirable, it is difficult to manufacture a surface layer having a $T_{max}/T_{min}$ value of less than 1.01. When the $T_{max}/T_{min}$ value exceeds the upper limit in the equations above, the heat conductivity characteristics of the quenched ribbon 8 are largely distributed among the sites depending on the material of the surface layer 52, causing heterogeneous distribution of the crystal grain size to unable stable magnetic properties to be obtained.

When the surface layer 52 comprises a plural layers of the surface layers having different compositions to one another as will be described hereinafter, the maximum and minimum values $T_{max}$ and $T_{min}$ are defined to be the sum of those of the respective layers.

While the method for forming the surface layer 52 is not particularly restricted so long as the thickness of the surface layer satisfies the foregoing equations, preferable methods comprise a chemical vapor deposition (CVD) method such as thermal CVD, plasma CVD and laser CVD, and a physical vapor deposition (PVD) method such as vacuum deposition, sputtering and ion plating. No surface machining is required in these methods after forming the surface layer 52 since the layer is uniformly formed. While electroplating, immersion plating, electroless plating and melt injection methods may be used, it is preferable that machining of the surface may be avoided after forming the surface layer 52. However, a chemical surface treatment such as washing, etching and passivation that required no machining such as grinding and polishing may be applied, if necessary.

Local growth of the surface layer 52 during the growth of the film can be suppressed since the surface roughness Ra of the circumference face 511 of the roll base 51 is relatively small when the surface layer 52 is formed on the circumference face. As a result, the surface roughness of the circumference face 521 of the surface layer 52 is also reduced.

The material for the surface layer 52 is not particularly restricted, but a metal layer comprising Cr, Ni, Pd, W or an alloy containing these metals is available. However, it is preferable to use a ceramic since the difference of the cooling speed between the roll contact surface 81 and free surface 82 of the quenched ribbon 8 can be more reduced. Examples of the ceramic include oxide based ceramics such as $Al_2O_3$, $SiO_2$, $TiO_2$, $Ti_2O_3$, $ZrO_2$, $Y_2O_3$, barium titanate and strontium titanate, nitride based ceramics such as AlN, $Si_3N_4$, TiN and BN, carbide based ceramics such as graphite, SiC, ZrC, NbC, $Al_4C_3$, $CaC_2$ and WC, or composite ceramics as a combination of two or more of these materials.

The surface layer 52 may comprise not only the single layer shown in the drawing, but also a laminated layer of plural layers having different compositions to one another. The adjoining layers has preferably good adhesive properties to one another, including such layers containing common elements between the two adjoining layers.

Even when the surface layer 52 is composed of a single layer, the composition of the layer need not be always a uniform one along the direction of thickness, for example, such components sequentially changing toward the direction of thickness (an inclined material) may be used.

While the mean thickness T of the surface layer 52 (the combined thickness in the case of the laminated layer) is not particularly restricted, it is preferably in the range of 0.5 to 50 $\mu$m, more preferably in the range of 1 to 20 $\mu$m.

When the mean thickness T of the surface layer 52 is too small, the roll contact surface 81 of the quenched ribbon 8 is liable to be amorphous due to rapid cooling rate depending on the material of the surface layer 52. Crystal grain size is coarsened, on the other hand, on the free surface 82 since the face is more slowly cooled than the roll contact surface 81. When the mean thickness T of the surface layer 52 is too large, on the contrary, the cooling rate becomes so slow that the crystal grain size is coarsened. Consequently, magnetic properties are deteriorated in both cases above.

Although the surface roughness Ra of the surface layer 52 is not particularly restricted since it depends on the material and composition constituting the surface layer 52, preferable roughness Ra is 0.03 to 8.5 $\mu$m, and more preferably 0.05 to 5 $\mu$m.

When the surface roughness Ra is too small, a slip may be caused on the puddle (basin) 7 formed by collision of the molten liquid 6 to the circumference face 521. When the extent of slip is remarkable, contact between the circumference face 521 and the quenched ribbon 8 becomes so insufficient that the crystal grain is coarsened and magnetic properties are deteriorated. When Ra is too large, on the other hand, the gap distance generated between the circumference face 521 and the quenched ribbon 8 is so increased that heat conductivity decreases as a whole and thereby magnetic properties are deteriorated when the contact time to be described hereinafter is short.

Although the radius of the cooling roll 5 is not particularly restricted, it is usually 50 to 1000 mm, more preferably 75 to 500 mm.

The entire cooling roll becomes to have inferior cooling ability when the radius of the cooling roll 5 is too small. Coarsening of the crystal grains with time arises during continuous production of the quenched ribbon 8 to make it difficult to securely obtain a quenched ribbon 8 having high magnetic properties. When the radius is too large, on the other hand, workability of the cooling roll becomes poor, or machining of the cooling roll becomes difficult, besides making the apparatus large size.

Magnetic powders having good magnetic properties are preferable for the ribbon shaped magnet material and the magnetic powder in the present invention. These materials include an alloy containing R (R denotes at least one of rare earth elements including Y), TM (TM denotes at least one of the transition metals) and B (boron), and preferably have the compositions described in [1] to [4] below:

[1] a composition of rare earth elements mainly comprising Sm and transition metals mainly comprising Co (referred as a Sm-Co based alloy hereinafter);

[2] a composition comprising R (R denotes at least one of rare earth elements including Y), transition metals (TM) mainly comprising Fe, and B (referred as a R—TM—B based alloy hereinafter);

[3] a composition comprising transition metals mainly comprising Sm, transition metals mainly comprising Fe, and interstitial elements mainly comprising N (referred as a Sm—Fe—N based alloy); and

[4] a composition containing R (R denotes at least one of the transition elements containing Y) and transition metals such as Fe as a basic component, and having a composite microstructure in which a soft magnetic phases and a hard magnetic phases are mixed in adjoining relation to one another.

Representative examples of the Sm—Co based alloy include $SmCo_5$ and $Sm_2TM_{17}$ (TM denotes a transition metal).

Representative examples of the R—Fe—B based alloy include a Nd—Fe—B based alloy, Pr—Fe—B based alloy, Nd—Pr—Fe—B based alloy, Nd—Dy—Fe—B based alloy, Ce—Nd—Fe—B based alloy, Ce—Pr—Nd—Fe—B based alloy and those in which a part of these elements are replaced with other transition metals such as Co and Ni.

Representative examples of the Sm—Fe—N based alloys include a Sm—Zr—Fe—Co—N based alloy whose principal phase comprises a $Sm_2Fe_{17}N_3$ or $TbCu_7$ phase prepared by nitriding a $Sm_2Fe_{17}$ alloy.

The rare earth elements include Y, La, Ce, Pr, Nd, Pm, Sm, Eu, Gd, Tb, Dy, Ho, Er, Tm, Yb, Lu and mish metal. These transition elements may be used alone, or a combination of two or more of them. Examples of the transition metals include Fe, Co and Ni, which may be used alone or a combination of two or more of them.

Elements such as Al, Cu, Ga, Si, Ti, V, Ta, Zr, Nb, Mo, Hf, Ag, Zn, P and Ge may be contained in the magnet material, if necessary, in order to improve magnetic properties such as coercive force and maximum magnetic energy product, or to improve such properties as heat resistance and corrosion resistance.

The composite microstructure (nano-composite microstructure) comprises the soft magnetic phases and hard magnetic phases, in which thickness and gain size of each phase are mixed in a nano-meter level (for example 1 to 100 nm). The soft magnetic phase and hard magnetic phase are mixed in adjoining relation to one another, generating a magnetic exchange interaction.

Since the direction of magnetization of the soft magnetic phase can be readily changed by the action of the external magnetic field, the magnetization curve of the entire magnetic system shows a "serpentine curve" having steps in the second quadrant of the B-H diagram (a J-H diagram), when the soft magnetic phase is mixed with the hard magnetic phase. However, magnetization of the soft magnetic phase is so strongly constrained by a coupling with magnetization of the hard magnetic phase around the soft magnetic phase when the size of the soft magnetic phase is as small as several tens nanometers, that the entire system behaves as a hard magnetic material.

A magnet comprising such composite microstructure (nano-composite microstructure) mainly possesses the following features;

1) Magnetization reversibly springs back in the second quadrat in the B-H diagram (J-H diagram)(referred as a "spring magnet);
2) The magnet is ready for magnetization, and is magnetized in a relatively low magnetic field;
3) The magnet has a relatively smaller temperature dependency of magnetic properties as compared with the case when the hard magnetic phase is used alone;
4) The magnet has a small time-dependent change of magnetic properties; and
5) Magnetic properties are not deteriorated when the magnet is pulverized.

Examples of the hard magnetic phase and soft magnetic phase in the R—TM—B based alloy are as follows;

Hard magnetic phase: $R_2TM_{14}B$ based phases (Tm denotes Fe, or Fe and Co), or $R_2TM_{14}BQ$ based phases (Q denotes at least one of Al, Cu, Ga, Si, Ti, V, Ta, Zr, Nb, Mo, Hf, Ag, Zn, P and Ge), and Soft magnetic phase: TM based phases (particularly α-Fe, α-(Fe, Co)), or an alloy phase of TM and Q.

While the circumferencial speed of the cooling roll 5 differs depending on the composition of the molten alloy liquid, constituting materials (composition) of the surface layer 52 and surface properties of the circumference face 521 (particularly wettability of the circumference face 521 to the molten liquid 6), it is preferably 5 to 60 m/sec, more preferably 10 to 45 m/sec.

When the circumference speed of the cooling roll 5 is too slow, the mean thickness t of the quenched ribbon 8 increases to show a tendency to increase the crystal grain size depending on the volume flow rate (the volume of the molten liquid 6 ejected per unit time). When the circumference speed of the cooling roll 5 is too rapid, on the other hand, the ribbon mostly comprises amorphous phases. Sufficient improvements of the magnetic properties cannot be expected in both cases, even by a heat treatment applied thereafter.

The quenching type ribbon manufacturing apparatus 1 as hitherto described is installed in a chamber (not shown), and is operated by filling the chamber with an inert gas or other atmospheric gases. It is in particular preferable that the atmospheric gas is an inert gas for preventing the quenched ribbon 8 from being oxidized. Examples of the inert gas include argon gas, helium gas and nitrogen gas.

A prescribed pressure higher than the pressure in the chamber is applied on the liquid surface of the molten liquid 6 in the cylinder 2. This molten liquid 6 is ejected out of the nozzle 3 by a differential pressure between the pressure applied on the liquid surface of the molten liquid 6 in the cylinder 2, and the pressure of the atmospheric gas in the chamber.

The magnet material is fed into the cylinder 2 of the quenching type ribbon manufacturing apparatus 1, is melted by heating with the coil 4, and the molten liquid 6 is ejected out of the nozzle 3. Then, the molten liquid 6 collides with the circumference face 521 of the cooling roll 5 and, after forming the puddle (basin) 7, the molten liquid is solidified by being quenched while it is pulled by the circumference face 521 of the rotating cooling roll 5, thereby the quenched ribbon 8 is continuously or intermittently formed. The roll contact surface 81 of the quenched ribbon 8 thus formed soon leaves off from the circumference face 521 of the cooling roll 5, and advances toward the direction of the arrow 9B as shown in FIG. 1. The solidified interface 71 of the molten liquid is shown by a dotted line in FIG. 2.

The nozzle 3 is not needed to be always placed just above the rotation center 54 of the cooling roll 5 for actually manufacturing the quenched ribbon 8, but the nozzle 3 is placed at a little shifted position toward the left from the center while the position of the cooling roll 5 is unchanged for manufacturing the quenched ribbon 8.

The quenched ribbon 8 obtained as described above preferably has a width w and thickness as uniform as possible. It is preferable that the quenched ribbon 8 has a mean thickness t of about 10 to 50 μm, more preferably about 15 to 40 μm.

When the mean thickness t is too small, the amorphous microstructure occupies a larger proportion in the quenched ribbon, and consequently the magnetic properties cannot be sufficiently improved even by a heat treatment thereafter. Mechanical strength of the quenched ribbon 8 is also decreases when the mean thickness t is too small to make it difficult to obtain a continuous quenched ribbon 8 resulting in a flake or powder form, consequently arising heterogeneous distribution of the magnetic properties due to uneven cooling. Productivity per unit time is also decreased.

When the mean thickness t is too large, on the other hand, internal heat conductivity of the quenched ribbon 8 governs the overall heat conductivity. Consequently, the crystal grain size at the free surface 82 side tends to be so coarsened that sufficient improvement in the magnetic properties cannot be expected.

A heat treatment may be applied to the quenched ribbon 8, in order to accelerate recrystallization of the amorphous microstructure or to make the microstructure uniform. The heat treatment condition is, for example, for about 0.5 to 300 minutes at 400 to 900° C.

Such heat treatment is preferably carried out in vacuum (for example under a reduced pressure of $1\times10^{-1}$ to $1\times10^{-6}$ Torr) or in an inert gas atmosphere such as nitrogen gas, argon gas or helium gas.

The quenched ribbon (ribbon shaped magnet material) 8 obtained as described above has a microstructure in which a fine crystalline microstructures or fine crystals are involved in the amorphous microstructure to exhibit excellent magnetic properties.

While the single roll method has been hitherto explained, a twin-roll method may be employed. Such quenching method is effective for improving magnetic properties and coercive force of the bonded magnet, since the metallic microstructure (crystal grains) can be made fine.

The magnetic powder according to the present invention can be obtained by pulverizing the quenched ribbon 8 obtained as described above.

The pulverizing method is not particularly restricted, but various pulverizing and crushing machines such as a ball mill, jet mill and pin mill may be used. The quenched ribbon may be pulverized in vacuum (for example under a reduced pressure of $1\times10^{-1}$ to $1\times10^{-6}$ Torr), or in a non-oxidizing atmosphere in an inert gas such as nitrogen gas, argon gas and helium gas, in order to prevent oxidation.

A heat treatment may be applied to the magnetic powder obtained in order to relax strain caused by pulverization, or to control the crystal grain size. The heat treatment condition is, for example, about 0.5 to 300 minutes at 350 to 850° C.

This heat treatment is also preferably carried out in vacuum (for example under a reduced pressure of $1\times10^{-1}$ to $1\times10^{-6}$ Torr), or in a non-oxidizing atmosphere in an inert gas such as nitrogen gas, argon gas and helium gas, in order to prevent oxidation.

When the bonded magnet is manufactured using the magnetic powder as described above, the magnetic powder has so good compatibility (wettability) with bonding materials (bonding resins) that the bonded magnet turns out to have high mechanical strength and good heat stability (heat resistance) and corrosion resistance. Accordingly, the magnetic powder is suitable for manufacturing the bonded magnet having high reliability.

The magnetic powder described above preferably has a mean crystal grain size of 500 nm or less, more preferably 200 nm or less, and further preferably in the range of about 10 to 100 nm. Excellent magnetic properties, particularly improvements of coercive force and squareness of demagnetization curve, cannot be expected when the mean crystal grain size is too large.

The mean crystal grain size as described above is preferable irrespective of the single phase microstructures as described in [1] to [3] above or the composite microstructure as described in [4] above, or irrespective of whether a heat treatment has been applied to the quenched ribbon 8 or to the magnetic powder, or irrespective of heat treatment conditions.

While the mean particle size of the magnetic powder is not particularly restricted, the preferable range is about 0.5 to 150 $\mu$m, more preferably about 1 to 80 $\mu$m, for manufacturing the bonded magnet (rare earth bonded magnet) to be described hereinafter, when prevention of oxidation and prevention of deterioration of the magnetic powder by grinding are taken into considerations. It is preferable that the magnetic powder has a somewhat irregular particle size distribution, in order to obtain good compatibility for molding the powder together with a small amount of the bonding resin as will be described hereinafter, because void ratio in the bonded magnet obtained can be reduced to further enhance mechanical strength of the bonded magnet beside further improving magnetic properties.

Such magnetic powder may comprise not only a homogeneous composition, but also comprise a mixture of two or more kinds of magnetic powders having different compositions. For example, a mixture of at least two or more of the compositions among those described in [1] to [4] may be used. Mixing different kinds of magnetic powders allows the advantages of respective magnetic powders to be possessed together, enabling more excellent magnetic properties to be obtained.

The mean particle size of each mixed magnetic powder may be different to one another when more than one kinds of the magnetic powders are mixed together. When such mixed powders are used, at least one of the mixed magnetic powders among the different kinds of powders may be manufactured by the foregoing method according to the present invention.

The magnet materials according to the present invention are not necessarily restricted to those used for manufacturing the bonded magnet, but those for use in a sintered magnet may be also used.

The bonded magnet according to the present invention will be described hereinafter.

The bonded magnet according to the present invention is prepared by bonding the magnetic powder with a bonding material (a binder) such as a bonding resin.

Any resins such as a thermoplastic resin or a heat curable resin may be used for the bonding resin.

Examples of the thermoplastic resin include polyamide (for example nylon 6, nylon 46, nylon 66, nylon 610, nylon 612, nylon 11, nylon 12, nylon 6–12 and nylon 6–66), thermoplastic poliimide, liquid crystal polymers such as aromatic polyester, polyphenylene oxide, polyphenylene sulfide, polyolefins such as polyethylene, polypropylene and ethylene-vinyl acetate copolymer, modified polyolefin, polycarbonate, polymethyl methacryate, polyesters such as polyethylene terephthalate and polybytylene terephthalate, polyether, polyetherketone, polyetherimide and polyacetal, and copolymers, blended resins and polymer alloys mainly comprising thereof. These polymers may be used alone, or as a combination of tow or more of them.

Polyamides are preferably used among them for their high mechanical strength, and liquid crystal polymers and polyphenylene sulfide are preferably used for improving heat resistance. These thermoplastic resins also have good compatibility in kneading with the magnetic powder.

These thermoplastic resins have such advantages as enabling selection ranges to be wide, for example emphasizing availability for molding or stressing heat resistance and mechanical strength, depending on the kind and copolymerization of the resins.

Examples of the heat curable reins include various epoxy reins such as bisphenol type, noborac type and napthalene type resins, phenol resins, urea resins, melamine resins, polyester (unsaturated polyester) resins, polyimide resins, silicone resins and polyurethane resins. These resins may be used alone, or in combination of two or more of them.

The epoxy resins, phenol resins, polyimide resins and silicon resins are preferable among these resins in their molding compatibility, mechanical strength and heat resistance, and the epoxy resins are most preferable. These heat curable resins are also excellent in availability for kneading, and uniformity in kneaded products.

The heat curable resin (non-cured) used may be either a liquid or a solid (powder) at room temperature.

A flexible (soft) bonded magnet can be prepared in the present invention using flexible binders such as natural rubber (NR), isoprene rubber (IR), butadiene rubbers such as butadiene rubber (BR, 1,2-BR), tryrene-butadiene rubber (SBR), special purpose diene rubbers such as chloroprene rubber (CR) and butadiene-acrylonitrile rubber (NBR), olefin rubbers such as butyl rubber (IIR), ethylene-propyrene rubber (EPM, ERDM), ethylene vinyl acetate rubber (EVA), acrylic rubber (ACM, ANM) and halogenated butyl rubber (X-IIR), such as urethane rubbers (AU, EU), ether rubbers such as hydrin rubber (CO, ECO, GCO, EGCO), polysulfide rubbers such as polysulfide rubbers (T), various rubbers such as silicone rubbers (Q), fluorinated rubbers (FKM, FZ) and chlorinated polyethylene (CM), and various thermoplastic elastomers such as styrene, polyolefin, polyvinyl chloride, polyurethane, polyester, polyamide, polybutadiene, trans polyisoprene, fluorinated rubber and chlorinated polyethylene elastomers.

While the bonded magnet according to the present invention may be either isotropic or anisotropic, the isotropic bonded magnet is preferable due to its easiness for manufacturing.

These bonded magnets can be manufactured as follows. A composition (a compound) for the bonded magnet containing the magnetic powder, binder resin and additives (such as an antioxidant and lubricant, if necessary) is prepared, and this composition for the bonded magnet is formed into a desired magnet shape in a magnetic field or without applying any magnetic field by a molding method such as compression molding (press molding), extrusion molding, injection molding or calendar molding. The molded body is cured by heating after molding, when a heat curable resin is used for the binder.

While extrusion molding and injection molding are advantageous due to their wide degree of freedom for selecting the shape and high productivity among the three molding methods described above, the content of the magnetic powder cannot be increased, or the bonded magnet cannot be highly compacted, as compared with compression molding, since sufficient fluidity of the compound in the molding machine should be secured in these molding methods in order to attain a sufficient molding compatibility. However, since a high magnetic flux density is obtainable in the present invention, and hence excellent magnetic properties can be attained without highly compacting the bonded magnet as will be described hereinafter, the bonded magnet manufactured by extrusion molding or injection molding can be endowed with the advantages of the molding methods.

The content (composition ratio) of the magnetic powder in the bonded magnet is not particularly restricted, but it is usually determined by considering the molding method or compatibility between molding property and high magnetic properties. Preferable content is about 75 to 99.5% by weight, more preferably about 85 to 98% by weight.

When the bonded magnet is manufactured by compression molding, the content is preferably about 90 to 99.5% by weight, more preferably about 93 to 98.5% by weight.

When the bonded magnet is manufactured by extrusion molding or injection molding, the content is preferably about 75 to 98% by weight, more preferably about 85 to 97% by weight.

The density ρ of the bonded magnet is determined the specific gravity of the magnetic powder contained therein, and the content and void ratio of the magnetic powder. While the density ρ is not particularly restricted in the bonded magnet according to the present invention, a density of 5.0 g/cm$^3$ or more is preferable, and a density of about 5.5 to 6.6 g/cm$^3$ is more preferable, in the bonded magnet using the binder resins (thermoplastic resins and heat curable resins) as the binder. The density may be less than 5.0 g/cm$^3$ when a flexible (soft) bonded magnet is used.

Since the magnetic powder according to the present invention has a relatively large magnetic flux density and coercive force, excellent magnetic properties (high coercive force and maximum magnetic energy product) can be obtained by molding into a bonded magnet that contains not only a large amount but also a relatively small amount of the magnetic powder.

The bonded magnet according to the present invention preferably has a coercive force $H_{cJ}$ of about 320 to 900 kA/m, more preferably about 400 to 720 kA/m. When the coercive force is smaller than the lower limit described above, demagnetization becomes evident when an inverse magnetic filed is applied when the bonded magnet is used for motors besides showing poor heat resistance at a high temperature. Magnetization is decreased, on the other hand, when the coercive force exceeds the upper limit described above. Accordingly, adjusting the coercive force $H_{cJ}$ within the foregoing range allows sufficient magnetization, and a sufficient magnetic flux density, to be achieved even when a sufficient magnetization magnetic field cannot be obtained in endowing the bonded magnet (especially a cylindrical magnet) with multi-polar magnetization, enabling a high performance bonded magnet, in particular a bonded magnet for use in motors, to be provided.

The bonded magnet according to the present invention preferably has a maximum magnetic energy product $(BH)_{max}$ of 60 kJ/m$^3$ or more, more preferably 65 kJ/m$^3$ or more, and most preferably 70 to 130 kJ/m$^3$. When the maximum magnetic energy product $(BH)_{max}$ is less than 60 kJ/m$^3$, a sufficient torque cannot be obtained in the applications as motors depending on the kind and structure of the motor.

The shape and dimension of the bonded magnet according to the present invention is not particularly restricted, but any shapes including a circular column, rectangular column, cylinder (a ring), circle, flat plate and warped plate are possible, and any sizes from a large to small sizes are also possible.

EXAMPLE

The examples of the present invention will be described hereinafter.

Example 1

A quenched ribbon with an alloy composition of $(Nd_{0.9}Dy_{0.1})_{8.9}Fe_{bal}Co_{7.8}B_{5.6}Al_{0.7}$ was obtained by the method described below.

Each starting material of Nd, Fe, Co, B and Al was weighed, and the mixture was melted in an Ar gas to mold into a mother ingot, followed by cutting a sample with a mass of about 15 g.

A quenching type ribbon manufacturing apparatus with the construction as shown in FIG. 1 was prepared, and the sample was placed into a quartz tube having a nozzle (an orifice) at its bottom.

Each cooling roll 5 having respective surface layers 52 (Nos. 1 to 3, and 6) was obtained by the chemical vapor deposition (CVD) method on the circumference face of a roll base (200 mm in diameter and 30 mm in width) made of copper. Chemical vapor deposition was a heat CVD method. An appropriate synthetic reaction gas was selected depending on the material of the surface layer. The CVD temperature was about 800 to 1500° C., although it is varied depending on the synthesis temperature.

Another cooling rolls 5 having respective surface layers 52 (Nos. 4 and 5) were also obtained by the physical vapor deposition (PVD) method on the circumference face of the roll base 51 with the same conditions as described above. Physical vapor deposition was carried out by ion plating. The temperature of the substrate was maintained at about 250 to 800° C., and the reaction gas was selected depending on the material of the surface layer. The acceleration voltage was 50 to 300 V.

Two layers with different compositions were laminated on the surface layer 52 in Nos. 5 and 6.

A Cr layer was deposited by electroplating as a comparative example on the circumference face of the roll base 51 with the same conditions as described above. A grinding and polishing processing was applied on the Cr layer thereafter to prepare the surface layer 52 (No. 7). Grinding was applied using a cylindrical grinding machine, and the surface was polished with a #1500 polishing paper.

The mean thickness T, the maximum and minimum thickness $T_{max}$ and $T_{min}$, and roughness Ra of the surface layer 52 were measured with respect to the cooling rolls 5 in condition Nos. 1 to 7 obtained as described above.

The thickness of the surface layer 52 was calculated by measuring the outer diameter of the roll using a magnification projector that has been previously positioned with respect to the roll base before and after providing the surface layer. The thickness of the surface layer 52 was measured at equally spaced 120 measuring points along the direction of circumference on the circumference face 521. T, $T_{max}$ and $T_{min}$ denote the mean thickness, the maximum and minimum thickness at the 120 measuring points, respectively.

The surface roughness Ra was determined by the same method as obtaining T, $T_{max}$ and $T_{min}$, wherein the surface roughness was measured at equally spaced 12 measuring points on the circumference face 521 and the values obtained were averaged.

The mean thickness T, the ratio between the maximum and minimum thickness $T_{max}/T_{min}$, and mean surface roughness Ra of the surface layer 52 of the cooling roll 5 are shown in Table 1.

After evacuating the chamber in which the quenching type ribbon manufacturing apparatus 1 is housed, helium gas was introduced and the atmosphere of the chamber was adjusted to a desired temperature and pressure.

The ingot sample in the quartz tube was melted by microwave induction heating with a coil 4. The circumference speed of the cooling roll 5 was adjusted to 16 m/sec, and the ejection pressure (a differential pressure between the inner pressure of the quartz tube and atmospheric pressure) of the molten liquid was adjusted to 60 kPa. The molten liquid was ejected from just above the rotation center of the cooling roll 5 onto the circumference face at the top of the cooling roll 5, thereby continuously manufacturing the quenched ribbon.

A piece of the quenched ribbon with a length of about 5 cm was taken out from respective continuous quenched ribbons, and five samples with a length of about 7 mm were successively prepared from the ribbon piece. The mean thickness t, mean crystal grain size and magnetic properties were measured with respect to each sample.

The mean thickness t was obtained by measuring the thickness at 20 measuring points per one sample with a microscope, and averaging the measured values. The mean crystal grain size was obtained from electron microscopic observation of the microstructure. With respect to the magnetic properties, the coercive force $H_{cJ}$ (kA/m) and maximum magnetic energy product $(BH)_{max}$ (kJ/m$^3$) were measured with a vibration sample type magnetometer (VSM). These results are summarized in Table 2.

As are evident from these results, it was confirmed that the quenched ribbons obtained in the condition Nos. 1 to 6 (the present invention) have stable and high magnetic properties.

On the contrary, the quenched ribbon obtained from the condition No. 7 (comparative example) has low magnetic properties in addition to heterogeneous distribution of the magnetic properties, although the sample is extracted from a continuously formed ribbon.

Example 2

After subjecting the quenched ribbons obtained in the condition Nos. 1 to 6 in Example 1 to a heat treatment at 680° C. for 300 seconds, these quenched ribbons were pulverized to obtain magnetic powders.

X-ray diffraction was performed at a diffraction angle range of 20° to 60° using Cu-Kα line for analyzing the phases of the magnetic powder obtained. It was possible to confirm a $R_2(Fe.Co)_{14}B$ type phase as a hard magnetic phase and a α-(Fe, Co) type phase as a soft magnetic phase, and these phases were confirmed to form composite microstructured (nano-composite microstructure) from the observation by a transmission type electron microscope (TEM).

The mean particle size of the magnetic powder obtained is shown in Table 3.

An epoxy resin (a binder resin) and a small amount of a hydrazine based antioxidant were mixed with each magnetic powder obtained as described above, and bonded magnet compositions (compounds) were prepared by kneading the mixture. The blending proportion between the magnetic powder and epoxy resin was approximately the same among the samples.

The compound was crushed into granules, which was weighed and filled into a die of a press machine to obtain a molded body by compression molding (with no magnetic field) at a pressure of 7 tons/cm$^2$.

After releasing the mold, the epoxy resin in the molded body was cured by heating at 150° C. (curing treatment) to obtain a round column type isotropic bonded magnet with a diameter of 10 mm and a height of 7 mm.

The content of the magnetic powder in each bonded magnet, and the density ρ of each bonded magnet are shown in Table 3.

After applying a pulse magnetization with a magnetic field of 2.0 MA/m to magnetizing the bonded magnet, the coercive force $H_{cJ}$ and maximum magnetic energy product $(BH)_{max}$ were measured with a direct current recording magnetic flux meter with a maximum impressed magnetic field of 2.9 MA/m. The measuring temperature was 23° C. (room temperature). These results are shown in Table 3.

Then, the samples were subjected to a heat resistance test, wherein an irreversible flux loss (initial irreversible flux loss) was measured when the temperature was returned to room temperature after holding the bonded magnet at 100° C. for 1 hour. The smaller absolute value of the irreversible flux loss (initial irreversible flux loss) indicates better heat resistance (heat stability). The irreversible flux loss obtained by the measurements are shown in Table 3.

These results show that excellent magnetic properties (high coercive force $H_{cJ}$ and maximum magnetic energy product $(BH)_{max}$) and good temperature characteristics (low irreversible flux loss) are obtained in all the bonded magnets obtained in the condition Nos. 1 to 6 in Example 2.

Example 3

A quenched ribbon 8 with an alloy composition of $(Nd_{0.7}Pr_{0.2}Dy_{0.1})_{9.0}Fe_{bal}Co_{8.0}B_{5.7}Si_{0.5}$ was obtained by the method described below.

A mixture of starting materials comprising Nd, Pr, Dy, Fe, Co, B and Si was at first weighed, and was melted in an induction melting furnace under the argon gas to melt and mold into a mother ingot. A sample with a mass of about 15 g was cut from the ingot.

Then, the quenching type ribbon manufacturing apparatus 1 was prepared, and the sample was placed into a quartz tube having a nozzle (circular orifice) 3 at the bottom.

A grinding and polishing processing was applied on the circumference face of the roll base (200 mm in diameter and 30 mm in width) made of copper, and six kinds of the roll bases 51 with a desired surface roughness Ra each were manufactured. The grinding processing was applied using a cylindrical grinding machine or a lathe, and buff polishing was also applied. A specular surface treatment was in particular applied in the condition No. 1.

The roughness Ra of the circumference face 511 of the roll base 51 was measured with respect to the cooling rolls 5 obtained as described above.

The surface roughness Ra was optically measured at 12 equally spaced measuring points on the circumference face 521, and the measured values were averaged.

Each cooling roll 5 having respective surface layers 52 (Nos. 1 to 3, and 6) was obtained by the chemical vapor deposition (CVD) method or physical vapor deposition (PVD) method on the circumference face 511 of a roll base 51. Chemical vapor deposition was a heat CVD method. An appropriate synthetic reaction gas was selected depending on the material of the surface layer. The CVD temperature was about 800 to 1500° C., although it is varied depending on the synthesis temperature. Physical vapor deposition was carried out by ion plating. The temperature of the substrate was maintained at about 250 to 800° C., and the reaction gas was selected depending on the material of the surface layer. The acceleration voltage was 50 to 300 V.

Two layers with different compositions to one another were laminated as the surface layer 52 in the condition Nos. 5 and 6.

Two kinds of cooling rolls 5 having a Cr layer as the surface layer 52 were prepared as comparative examples by the method described below (condition Nos. 7 and 8).

At first, a grinding processing and polishing processing were applied on the circumference face 511 of the roll base 51 prepared by the same conditions as manufacturing the cooling rolls in No. 1 to 6, to obtain the roll bases 51 with the surface roughness Ra of the circumference face 511 of 8.2 $\mu$m and 4.5 $\mu$m, respectively. Cr layers were formed by electroplating on each circumference face 511 of these roll bases 51. No surface machining was applied to one of the Cr layer formed, and the surface layer was directly used for the cooling rolls in the condition No. 7.

Grinding processing and polishing processing were applied to the another Cr layer after electroplating as the surface layer 52, which was used for the cooling roll of the condition No. 8. The grinding processing and polishing processing were carried out by the same method as used in the roll base 51.

The mean thickness T, and the surface roughness Ra of the circumference face 521 of the surface layer 52 were measured with respect to each cooling roll 5 in the condition Nos. 1 to 8 obtained as described above.

The thickness of the surface layer 52 was measured with a fluorescence X-ray type thickness gage. The thickness of the surface layer 52 was measured at 120 measuring points along the circumference direction on the circumference face 521, and the mean thickness T was calculated by averaging the measured values.

The surface roughness Ra was measured by the same method as measuring the surface roughness of the circumference face 511 of the roll base 51.

The surface roughness Ra of the circumference face 511 of the roll base 51, the method for forming the surface layer 52, the material, mean thickness T and surface roughness of the surface layer 52 are shown in Table 4.

After evacuating the chamber in which the quenching type ribbon manufacturing apparatus 1 is housed, the chamber was adjusted to a desired temperature and atmosphere by introducing helium gas.

The ingot sample in the quartz tube was melted by microwave induction heating with a coil 4. The circumference speed of the cooling roll 5 was adjusted to 17 m/sec, the ejection pressure of the molten liquid (the differential pressure between the inner pressure of the quartz tube and the atmospheric pressure) was adjusted to 40 kPa, and the pressure of the atmospheric gas was adjusted to 60 kPa. The molten liquid was ejected from just above the rotation center of the cooling roll 5 onto the circumference face 521 at the top of the cooling roll 5, thereby continuously manufacturing the quenched ribbon.

A piece of the quenched ribbon with a length of about 5 cm was taken out of each quenched ribbon obtained, and five samples with a length of 7 mm were successively prepared from each sample piece to measure the mean thickness t, mean crystal grain size and magnetic properties of each sample.

The thickness was measured at 20 measuring sites per one sample with a microscope, and the measured valued were averaged. The mean crystal grain size was determined from the result of a microscopic observation of the microstructure. With respect to the magnetic properties, the coercive force $H_{cJ}$ (kA/m) and maximum magnetic energy product $(BH)_{max}$ (kJ/m$^3$) were measured with a vibration sample magnetometer (VSM). These results are summarized in Table 5.

It was confirmed from these results that high magnetic properties were securely obtained in the quenched ribbons obtained in the condition Nos. 1 to 6 (the present invention).

Low magnetic properties were obtained, on the contrary, in the quenched ribbons obtained in the condition Nos. 7 and 8 (the comparative examples). The quenched ribbon obtained in the condition No. 8 showed heterogeneous distribution of the magnetic properties, although the sample is extracted from a continuously formed ribbon.

Example 4

Magnetic powders were obtained by subjecting the quenched samples obtained in the condition Nos. 1 to 6 in Example 3 to a heat treatment at 690° C. for 300 seconds in an argon atmosphere, followed by pulverizing these quenched ribbons.

The phase analysis of the magnetic powder obtained was performed by a X-ray diffraction analysis using the Cu-K$\alpha$ line at a diffraction angle range of 20° to 60°. Diffraction peaks corresponding to a $R_2(Fe.Co)_{14}B$ type phase as a hard magnetic phase and a $\alpha$-(Fe, Co) phase as a soft magnetic phase were confirmed from the diffraction pattern, and a composite microstructure (a nano-composite microstructure) was confirmed to be formed from the result of observation with a transmission type electron microscope (TEM).

Each mean particle size of the magnetic powder obtained is shown in Table 6.

An epoxy resin (binder resin) and a small amount of hydrazine based antioxidant were mixed with each magnetic powder obtained as described above, and the mixture was kneaded to prepared a bonded magnet composition (a compound). The blending ratio (weight ratio) between the magnetic powder and epoxy resin was adjusted to be approximately equal among the samples.

The compound was then crushed into granules, and these granules were weighed and filled into a die of a press machine to obtain a molded body by compressing the granules under a pressure of 7 tons/cm$^2$ (with no magnetic field).

After releasing from the die, the epoxy resin was cured by heating at 150° C. (curing treatment) to obtain a round column of an isotropic bonded magnet with a diameter of 10 mm and a height of 7 mm.

The content of the magnetic powder in each bonded magnet, and the density ρ of each bonded magnet are shown in Table 3.

After applying pulse magnetization field with a magnetic filed of 3.2 MA/m to magnetize the bonded magnet, the coercive force $H_{cJ}$ and maximum magnetic energy product $(BH)_{max}$ were measured with a direct current recording magnetic flux meter with a maximum applied magnetic field of 2.0 MA/m. The measuring temperature was 23° C. (room temperature). These results are shown in Table 6.

Then, the samples were subjected to a heat resistance test, wherein an irreversible flux loss (initial irreversible flux loss) was measured when the temperature was returned to room temperature after holding the bonded magnet at 100° C. for 1 hour. The smaller absolute value of the irreversible flux loss (initial irreversible flux loss) shows better heat resistance (heat stability) . The results of measurements obtained are shown in Table 6.

Example 5

Two kinds of the cooling rolls 5 were manufactured by the method as described below.

Grinding processing and polishing processing were applied on the circumference face 511 of two roll bases 51 (a diameter of 200 mm and a width of 30 mm). One of the roll base 51 had a surface roughness Ra of the circumference face 511 of 1.0 μm (the condition No. 9), and the other roll base 51 had a surface roughness Ra of the circumference face 511 of 12 μm (the condition No. 10). The methods for the grinding processing and polishing processing, and the measurement of the surface roughness Ra were the same as those in Example 3.

A surface layer 52 of NbC with a mean thickness T of 10 μm was formed on each roll base 51 by CVD. The surface roughness Ra on the circumference face 521 of the surface layer 52 was measured by the same method as in Example 1. The surface roughness on the circumference face 511 of the roll base 51, and the surface roughness on the circumference face 521 of the surface layer 52 are shown in Table 7.

After subjecting the quenched ribbons, manufactured using the two kinds of cooling rolls 5 obtained as described above and having the same compositions as those in Example 3, to a heat treatment at 675° C. for 600 seconds, coercive force $H_{cJ}$ (kA/m) and maximum magnetic energy product $(BH)_{max}$ were measured using a vibration sample magnetometer. These results are shown in Table 7.

These results clearly show that high magnetic properties can be obtained by adjusting the surface roughness Ra on the circumference 511 of the roll base 51 within the range of the present invention.

Example 6

Magnetic powders were obtained by pulverizing tow kinds of the quenched ribbons obtained in Example 5.

The phase analysis of the magnetic powder obtained was performed by a X-ray diffraction analysis within a diffraction angle of 20 to 60° using the Cu-Kα line. Diffraction peaks corresponding to a $R_2(Fe.Co)_{14}B$ type phase as a hard magnetic phase and a α-(Fe, Co) phase as a soft magnetic phase were confirmed from the diffraction pattern, and a composite microstructure (a nano-composite microstructure) was confirmed to be formed from the result of observation with a transmission type electron microscope (TEM).

Each mean particle size of the magnetic powder obtained is shown in Table 8.

A round column of an isotropic bonded magnet with a diameter of 10 mm and a height of 7 mm was obtained by the same method as in Example 2 using each magnetic powder obtained as described above.

The content of the magnetic powder in each bonded magnet, and the density ρ of each bonded magnet are shown in Table 8.

After applying pulse magnetization with a magnetic filed of 3.2 MA/m to magnetizing the bonded magnet, the coercive force $H_{cJ}$ and maximum magnetic energy product $(BH)_{max}$ were measured with a direct current recording magnetic flux meter with a maximum impressed magnetic field of 2.0 MA/m. The measuring temperature was 23° C. (room temperature). These results are shown in Table 8.

Then, the samples were subjected to a heat resistance test, wherein an irreversible flux loss (initial irreversible flux loss) was measured when the temperature was returned to room temperature after holding the bonded magnet at 100° C. for 1 hour. The smaller absolute value of the irreversible flux loss (initial irreversible flux loss) shows better heat resistance (heat stability). The results of measurements obtained are shown in Table 8.

These results indicate that excellent magnetic properties (high coercive force $H_{cJ}$ and maximum energy product $(BH)_{max}$, and good temperature characteristics (low irreversible flux loss)) are obtained in the bonded magnet according to the present invention. On the contrary, only low magnetic properties and poor temperature characteristics are obtainable in the comparative examples.

As hitherto described, the following effects are obtained in the present invention.

The difference between the microstructures at the roll contact surface side and free surface side of the quenched ribbon, and the difference of the crystal grain size due to different cooling rate can be reduced to obtain a magnet material and magnetic powder having excellent magnetic properties, thereby enabling the bonded magnet manufactured from these materials to exhibit good magnetic properties.

In particular, more excellent magnetic properties can be obtained by setting the constituting materials, the thickness, and surface roughness of the surface layer formed on the cooling roll, the diameter and circumference speed of the cooling roll, the thickness of the quenched ribbon, the particle size and the mean particle size of the magnetic powder within a preferable range.

Since equal or more level of magnetic properties can be exhibited in a bonded magnet having a smaller volume than the conventional bonded magnet, more small size and high performance motors may be manufactured.

Sufficient magnetic properties can be obtained without attempting to make the bonded magnet high density in producing the bonded magnet, since high magnetic properties can be attained. Consequently, a reliable bonded magnet that is able to improve molding compatibility as well as dimensional accuracy, corrosion resistance and heat resistance can be easily manufactured.

Since the bonded magnet is not required to be high density, extrusion molding and injection molding, which are not suitable for making the bonded magnet high density as compared with compression molding, can be favorably applied to manufacturing the bonded magnet. The same effects as described above are also valid in the bonded magnet manufactured by the method described above. Accordingly, the selection range of the molding methods of the bonded magnet, as well as the degree of freedom of selection of the bonded magnet shapes, can be expanded.

INDUSTRIAL APPLICABILITY

The bonded magnet according to the present invention s suitable for use in handy electronic appliances such as a pocket bell (pager) and portable phone, since the bonded magnet is applicable for small size and high performance motors.

TABLE 1

CONDITION FOR FORMING SURFACE LAYER OF COOLING ROLL

| CONDITION NO. | FORMING METHOD | STARTING MATERIAL | T (μm) | $T_{max}/T_{min}$ | SURFACE ROUGHNESS Ra (μm) |
|---|---|---|---|---|---|
| 1 (PRESENT INVENTION) | CVD | $Al_2O_3$ | 8 | 1.08 | 0.1 |
| 2 (PRESENT INVENTION) | CVD | NbC | 8 | 1.32 | 0.5 |
| 3 (PRESENT INVENTION) | CVD | ZrC | 30 | 1.50 | 1.2 |
| 4 (PRESENT INVENTION) | PVD | $Si_3N_4$ | 50 | 2.05 | 4.0 |
| 5 (PRESENT INVENTION) | PVD | ZrC*/$ZrO_2$ | 27 | 1.25 | 0.9 |
| 6 (PRESENT INVENTION) | CVD | AlN/TiN | 45 | 1.41 | 2.4 |
| 7 (COMPARATIVE EXAMPLE) | ELECTRO-PLATING | Cr | 100 | 3.10 | 0.5 |

*UPPERMOST LAYER SIDE

TABLE 2

PROPERTIES OF QUENCHED RIBBON

| CONDITION NO. | SAMPLE NO. | THICKNESS t (μm) | MEAN CRYSTAL GRAIN SIZE (nm) | $H_{cJ}$ (kA/m) | $(BH)_{max}$ (kJ/m³) |
|---|---|---|---|---|---|
| 1 (PRESENT INVENTION) | SAMPLE 1 | 28 | 25 | 570 | 160 |
| | SAMPLE 2 | 27 | 26 | 565 | 158 |
| | SAMPLE 3 | 27 | 24 | 575 | 162 |
| | SAMPLE 4 | 28 | 26 | 560 | 159 |
| | SAMPLE 5 | 27 | 27 | 558 | 156 |
| 2 (PRESENT INVENTION) | SAMPLE 1 | 26 | 23 | 572 | 159 |
| | SAMPLE 2 | 25 | 27 | 551 | 153 |
| | SAMPLE 3 | 26 | 25 | 561 | 156 |
| | SAMPLE 4 | 27 | 30 | 540 | 149 |
| | SAMPLE 5 | 25 | 24 | 555 | 157 |
| 3 (PRESENT INVENTION) | SAMPLE 1 | 29 | 30 | 535 | 139 |
| | SAMPLE 2 | 30 | 32 | 520 | 135 |
| | SAMPLE 3 | 29 | 25 | 547 | 144 |
| | SAMPLE 4 | 33 | 35 | 516 | 130 |
| | SAMPLE 5 | 28 | 28 | 539 | 139 |
| 4 (PRESENT INVENTION) | SAMPLE 1 | 24 | 28 | 514 | 135 |
| | SAMPLE 2 | 30 | 37 | 501 | 126 |
| | SAMPLE 3 | 23 | 25 | 526 | 141 |
| | SAMPLE 4 | 31 | 40 | 489 | 121 |
| | SAMPLE 5 | 28 | 32 | 510 | 130 |
| 5 (PRESENT INVENTION) | SAMPLE 1 | 27 | 28 | 541 | 154 |
| | SAMPLE 2 | 28 | 30 | 539 | 152 |
| | SAMPLE 3 | 26 | 27 | 544 | 156 |
| | SAMPLE 4 | 28 | 32 | 536 | 150 |
| | SAMPLE 5 | 25 | 26 | 547 | 158 |
| 6 (PRESENT INVENTION) | SAMPLE 1 | 30 | 34 | 514 | 132 |
| | SAMPLE 2 | 31 | 35 | 510 | 128 |
| | SAMPLE 3 | 30 | 31 | 520 | 137 |
| | SAMPLE 4 | 33 | 39 | 499 | 121 |
| | SAMPLE 5 | 29 | 29 | 523 | 140 |

TABLE 2-continued

PROPERTIES OF QUENCHED RIBBON

| CONDITION NO. | SAMPLE NO. | THICKNESS t (μm) | MEAN CRYSTAL GRAIN SIZE (nm) | $H_{cJ}$ (kA/m) | $(BH)_{max}$ (kJ/m$^3$) |
|---|---|---|---|---|---|
| 7 (COMPARATIVE EXAMPLE) | SAMPLE 1 | 31 | 63 | 275 | 68 |
| | SAMPLE 2 | 35 | 78 | 260 | 50 |
| | SAMPLE 3 | 26 | 45 | 318 | 99 |
| | SAMPLE 4 | 38 | 81 | 232 | 43 |
| | SAMPLE 5 | 33 | 51 | 294 | 82 |

TABLE 3

MEAN PARTICLE SIZE OF MAGNETIC POWDER AND PROPERTIES OF BONDED MAGNET

| CONDITION NO. | MEAN PARTICLE SIZE (μm) | CONTENT OF MAGNETIC POWDER (wt %) | ρ (g/cm$^3$) | $H_{cJ}$ (kA/M) | (BH)max (kJ/m$^3$) | IRREVERSIBLE DEMAGNETIZATION FACTOR (%) |
|---|---|---|---|---|---|---|
| 1 (PRESENT INVENTION) | 55 | 98.0 | 6.35 | 568 | 115.1 | −2.5 |
| 2 (PRESENT INVENTION) | 60 | 98.0 | 6.32 | 552 | 112.9 | −3.1 |
| 3 (PRESENT INVENTION) | 67 | 97.5 | 6.15 | 530 | 103.9 | −3.5 |
| 4 (PRESENT INVENTION) | 53 | 97.0 | 5.98 | 505 | 93.2 | −4.5 |
| 5 (PRESENT INVENTION) | 40 | 97.0 | 6.05 | 541 | 103.2 | −2.8 |
| 6 (PRESENT INVENTION) | 75 | 98.0 | 6.30 | 515 | 102.5 | −3.8 |

TABLE 4

CONDITIONS OF COOLING ROLL

| CONDITION NO. | FORMING METHOD | ROUGHNESS OF CIRCUMFERENCE FACE OF ROLL BASE Ra (μm) | STARTING MATERIAL | THICKNESS T (μm) | ROUGHNESS OF CIRCUMFERENCE FACE OF SURFACE LAYER Ra (μm) |
|---|---|---|---|---|---|
| 1 (PRESENT INVENTION) | CVD | 0.05 | $Al_2O_3$ | 8 | 0.1 |
| 2 (PRESENT INVENTION) | CVD | 0.4 | NbC | 8 | 0.5 |
| 3 (PRESENT INVENTION) | CVD | 1.0 | ZrC | 30 | 1.2 |
| 4 (PRESENT INVENTION) | PVD | 3.5 | $Si_3N_4$ | 50 | 4.0 |
| 5 (PRESENT INVENTION) | PVD | 4.8 | ZrC*/$ZrO_2$ | 20 | 0.9 |
| 6 (PRESENT INVENTION) | CVD | 6.5 | AlN*/TiN | 40 | 2.4 |
| 7 (COMPARATIVE EXAMPLE) | PLATING (NO GRINDING AND POLISHING) | 8.2 | Cr | 100 | 8.7 |

TABLE 4-continued

| CONDITIONS OF COOLING ROLL | | | | | |
|---|---|---|---|---|---|
| CONDITION NO. | FORMING METHOD | ROUGHNESS OF CIRCUMFERENCE FACE OF ROLL BASE Ra (μm) | STARTING MATERIAL | THICKNESS T (μm) | ROUGHNESS OF CIRCUMFERENCE FACE OF SURFACE LAYER Ra (μm) |
| 8 (COMPARATIVE EXAMPLE) | PLATING (WITH GRINDING AND POLISHING) | 4.5 | Cr | 40 | 0.5 |

*UPPERMOST SURFACE LAYER SIDE

TABLE 5

| PROPERTIES OF QUENCHED RIBBON | | | | | |
|---|---|---|---|---|---|
| CONDITION NO. | SAMPLE NO. | THICKNESS t (μm) | MEAN CRYSTAL GRAIN SIZE (nm) | $H_{cJ}$ (kA/m) | $(BH)_{max}$ (kJ/m$^3$) |
| 1 (PRESENT INVENTION) | SAMPLE 1 | 28 | 26 | 563 | 158 |
| | SAMPLE 2 | 29 | 27 | 559 | 156 |
| | SAMPLE 3 | 28 | 25 | 566 | 159 |
| | SAMPLE 4 | 27 | 24 | 574 | 162 |
| | SAMPLE 5 | 27 | 24 | 569 | 161 |
| 2 (PRESENT INVENTION) | SAMPLE 1 | 25 | 25 | 557 | 158 |
| | SAMPLE 2 | 27 | 30 | 541 | 149 |
| | SAMPLE 3 | 25 | 27 | 562 | 156 |
| | SAMPLE 4 | 26 | 26 | 553 | 154 |
| | SAMPLE 5 | 26 | 23 | 572 | 159 |
| 3 (PRESENT INVENTION) | SAMPLE 1 | 28 | 24 | 548 | 145 |
| | SAMPLE 2 | 32 | 35 | 519 | 130 |
| | SAMPLE 3 | 29 | 28 | 540 | 138 |
| | SAMPLE 4 | 29 | 29 | 537 | 139 |
| | SAMPLE 5 | 30 | 32 | 520 | 136 |
| 4 (PRESENT INVENTION) | SAMPLE 1 | 28 | 32 | 512 | 129 |
| | SAMPLE 2 | 25 | 28 | 516 | 135 |
| | SAMPLE 3 | 29 | 36 | 500 | 127 |
| | SAMPLE 4 | 24 | 25 | 527 | 142 |
| | SAMPLE 5 | 32 | 40 | 488 | 123 |
| 5 (PRESENT INVENTION) | SAMPLE 1 | 27 | 27 | 543 | 155 |
| | SAMPLE 2 | 28 | 30 | 539 | 152 |
| | SAMPLE 3 | 26 | 28 | 544 | 156 |
| | SAMPLE 4 | 29 | 31 | 537 | 150 |
| | SAMPLE 5 | 25 | 26 | 546 | 159 |
| 6 (PRESENT INVENTION) | SAMPLE 1 | 31 | 33 | 516 | 133 |
| | SAMPLE 2 | 32 | 35 | 515 | 129 |
| | SAMPLE 3 | 30 | 31 | 521 | 138 |
| | SAMPLE 4 | 33 | 39 | 497 | 120 |
| | SAMPLE 5 | 29 | 28 | 525 | 143 |
| 7 (COMPARATIVE EXAMPLE) | SAMPLE 1 | 32 | 63 | 252 | 51 |
| | SAMPLE 2 | 30 | 60 | 256 | 55 |
| | SAMPLE 3 | 26 | 56 | 263 | 60 |
| | SAMPLE 4 | 27 | 58 | 260 | 59 |
| | SAMPLE 5 | 33 | 65 | 250 | 57 |
| 8 (COMPARATIVE EXAMPLE) | SAMPLE 1 | 35 | 55 | 283 | 78 |
| | SAMPLE 2 | 31 | 45 | 317 | 98 |
| | SAMPLE 3 | 38 | 68 | 270 | 64 |
| | SAMPLE 4 | 29 | 40 | 402 | 110 |
| | SAMPLE 5 | 26 | 32 | 498 | 125 |

TABLE 6

| MEAN PARTICLE SIZE OF MAGNETIC POWDER AND PROPERTIES OF BONDED MAGNET | | | | | | |
|---|---|---|---|---|---|---|
| CONDITION NO. | MEAN PARTICLE SIZE (μm) | CONTENT OF MAGNETIC POWDER (wt %) | ρ (g/cm$^3$) | $H_{cJ}$ (kA/M) | (BH)max (Kj/m$^3$) | IRREVERSIBLE DEMAGNETIZATION FACTOR (%) |
| 1 (PRESENT INVENTION) | 57 | 98.1 | 6.35 | 569 | 115.0 | −2.4 |

TABLE 6-continued

MEAN PARTICLE SIZE OF MAGNETIC POWDER AND PROPERTIES OF BONDED MAGNET

| CONDITION NO. | MEAN PARTICLE SIZE (μm) | CONTENT OF MAGNETIC POWDER (wt %) | ρ (g/cm³) | $H_{cJ}$ (kA/M) | (BH)max (Kj/m³) | IRREVERSIBLE DEMAGNETIZATION FACTOR (%) |
|---|---|---|---|---|---|---|
| 2 (PRESENT INVENTION) | 61 | 98.0 | 6.31 | 553 | 112.6 | −3.2 |
| 3 (PRESENT INVENTION) | 68 | 97.4 | 6.14 | 532 | 103.8 | −3.5 |
| 4 (PRESENT INVENTION) | 52 | 97.1 | 5.99 | 504 | 93.0 | −4.6 |
| 5 (PRESENT INVENTION) | 41 | 97.0 | 6.05 | 544 | 103.0 | −2.9 |
| 6 (PRESENT INVENTION) | 76 | 97.9 | 6.29 | 515 | 102.6 | −3.8 |

TABLE 7

SURFACE ROUGHNESS Ra OF THE ROLL BASE AND SURFACE LAYER, AND PROPERTIES OF THE QUENCHED RIBBON

| CONDITION NO. | ROUGHNESS Ra OF ROLL BASE SURFACE (μm) | ROUGHNESS Ra OF SURFACE LAYER (μm) | Br (T) | $H_{cJ}$ (kA/m) | $(BH)_{max}$ (kJ/m³) |
|---|---|---|---|---|---|
| 9 (PRESENT INVENTION) | 1.0 | 1.2 | 10.1 | 552 | 149 |
| 10 (COMPARATIVE EXAMPLE) | 12.0 | 12.3 | 7.6 | 242 | 69 |

TABLE 8

MEAN PARTICLE SIZE OF MAGNETIC POWDER AND PROPERTIES OF BONDED MAGNET

| CONDITION NO. | MEAN PARTICLE SIZE (μm) | CONTENT OF MAGNETIC POWDER (wt %) | DENSITY ρ (g/cm³) | $H_{cJ}$ (kA/M) | (BH)max (kJ/m³) | IRREVERSIBLE DEMAGNETIZATION FACTOR (%) |
|---|---|---|---|---|---|---|
| 9 (PRESENT INVENTION) | 65 | 98.0 | 6.32 | 550 | 108.1 | −2.8 |
| 10 (COMPARATIVE EXAMPLE) | 59 | 98.0 | 6.34 | 239 | 39.8 | −15.3 |

What is claimed is:

1. A cooling roll for manufacturing a magnet material having a surface layer on an entire outer circumference of a roll base of the cooling roll, wherein the maximum thickness $T_{max}$ and the minimum thickness $T_{min}$ of the surface layer satisfy the relation of $1.01 \leqq T_{max}/T_{min} \leqq 3$.

2. A cooling roll for manufacturing a magnet material having a roll base and a ceramic surface layer provided on an entire outer circumference thereof, wherein the surface roughness Ra of a bonding face between the roll base and the surface layer is 0.03 to 8 μm.

3. A cooling roll according to claim 1, wherein the surface layer has been manufactured without applying any machining on a surface of the surface layer.

4. A cooling roll according to claim 1, wherein the surface layer has been formed by a chemical vapor deposition (CVD) method or a physical vapor deposition (PVD) method.

5. A cooling roll according to claim 1, wherein the surface layer comprises a ceramic.

6. A cooling roll according to claim 1, wherein a mean thickness of the surface layer is 0.5 to 50 μm.

7. A cooling roll according to claim 1, wherein a surface roughness Ra of the surface layer is 0.03 to 8 μm.

8. A cooling roll according to claim 1, wherein a radius of the cooling roll is 50 to 1000 mm.

9. A cooling roll for manufacturing a magnet material comprising:

a roll base;

a ceramic surface with a thickness of 0.5 to 50 μm disposed on said roll base;

wherein a surface of said roll base has a surface roughness Ra of 0.03 to 8 μm; and wherein said surface layer has been disposed by a CVD or a PVD method.

10. A cooling roll according to claim 9, wherein the surface layer is formed of a plurality of layers with a thickness of 0.5 to 50 μm.

11. A cooling roll according to claim 2, wherein the surface layer has been manufactured without applying any machining on its surface.

12. A cooling roll according to claim 2, wherein the surface layer has been formed by a chemical vapor deposition (CVD) method or a physical vapor deposition (PVD) method.

13. A cooling roll according to claim 2, wherein a mean thickness of the surface layer is 0.5 to 50 μm.

14. A cooling roll according to claim 2, wherein a surface roughness Ra of the surface layer is 0.03 to 8 μm.

15. A cooling roll according to claim 2, wherein a radius of the cooling roll is 50 to 1000 mm.

* * * * *

UNITED STATES PATENT AND TRADEMARK OFFICE

CERTIFICATE OF CORRECTION

PATENT NO. : 6,536,507 B1 
APPLICATION NO. : 09/869817
DATED : March 25, 2003
INVENTOR(S) : Akira Aral and Hiroshi Kato It is certified that error appears in the above-identified patent and that said Letters Patent is hereby corrected as shown below:

Col. 1, line 20: “an” should be -- a --.
Col. 1, line 35: “without” should be -- with --.

Col. 2, line 19: “unable” should be -- enable --.

Col. 3, line 46 through Col. 5, line 27: Delete all. (The entire specification substitution paragraphs of the Preliminary Amendment were added here, as well as at the appropriate paragraph line.)

Col. 5, line 34: Delete “according to the present invention”.
Col. 5, line 63: “heated” should be -- heater --.

Col. 6, line 02: Delete “is”.
Col. 6, line 35: “unable” should be -- enable --.
Col. 6, line 59: “unable” should be -- enable --.

Col. 8, line 41: “phases” (two instances) should be -- phase --.

Col. 9, line 03: “gain” should be -- grain --.
Col. 9, line 24: “quadrat” should be -- quadrant --.
Col. 9, line 25: “magnet” should be -- magnet” --.
Col. 9, line 38: “Tm” should be -- TM --.

Col. 10, line 37: Delete “is”.

Col. 12, line 19: “poliimide” should be -- polyimide --.
Col. 12, line 23: “methacryate” should be -- methacrylate --.
Col. 12, line 24: “polybytylene” should be -- polybutylene --.
Col. 12, line 28: “tow” should be -- two --.
Col. 12, line 39: “reins” should be -- resins --.
Col. 12, line 40: “reins” should be -- resins --.
Col. 12, line 40: “noborac” should be -- novolac --.
Col. 12, line 56: “tryene” should be -- styrene --.
Col. 12, line 59: “propyrene” should be -- propylene --.

Col. 13, line 47: After “determined” insert -- by--.

UNITED STATES PATENT AND TRADEMARK OFFICE

CERTIFICATE OF CORRECTION

PATENT NO. : 6,536,507 B1
APPLICATION NO. : 09/869817
DATED : March 25, 2003
INVENTOR(S) : Akira Aral and Hiroshi Kato It is certified that error appears in the above-identified patent and that said Letters Patent is hereby corrected as shown below:

Col. 14, line 2: "filed" should be -- field --.

Col. 16, lines 11-12: "microstructured" should be -- microstructures --.

Col. 18, line 24: "valued" should be -- values --.
Col. 18, line 62: "prepared" should be -- prepare --.

Col. 19, line 63: "tow" should be -- two --.

Col. 20, line 18: "filed" should be -- field --.

Col. 25, table 6, line 5: "(Kj/$m^3$" should be -- (kJ/$m^3$) --.

Col. 27, table 6-continued, line 5: "(Kj/m3" should be -- (kJ/$m^3$) --.

Signed and Sealed this

Twenty-fifth Day of December, 2007

JON W. DUDAS
*Director of the United States Patent and Trademark Office*